United States Patent [19]

Longenette

[11] Patent Number: 4,592,148

[45] Date of Patent: Jun. 3, 1986

[54] CHALK LINE REEL STRUCTURE

[76] Inventor: Paul Longenette, 330 N. Zane Hwy., Martins Ferry, Ohio 43935

[21] Appl. No.: 630,375

[22] Filed: Jul. 12, 1984

[51] Int. Cl.[4] ..... B65H 75/48

[52] U.S. Cl. ..... 33/414; 242/107.3; 242/107.5; 242/107.6

[58] Field of Search ..... 242/107.3, 107.5, 107.6, 242/107; 33/414

[56] References Cited

U.S. PATENT DOCUMENTS

| | | | |
|---|---|---|---|
| 2,603,430 | 7/1952 | Hofer | 242/107.3 |
| 2,655,728 | 10/1953 | Cook | 33/414 |
| 3,208,769 | 9/1965 | Onori | 242/107.5 |
| 4,340,191 | 7/1982 | Zavatkay | 242/107.5 X |

FOREIGN PATENT DOCUMENTS

| | | | |
|---|---|---|---|
| 646564 | 11/1928 | France | 242/107.5 |
| 793187 | 1/1936 | France | 33/414 |

*Primary Examiner*—John M. Jillions

*Attorney, Agent, or Firm*—Eugene E. Geoffrey, Jr.

[57] ABSTRACT

A chalk line reel structure which includes a housing, a reel carrying a chalk line disposed within the housing which has an opening through which the chalk line extends, a spring and enclosure therefor carried by said housing with one end of the spring affixed effectively to the reel and the other end to the enclosure and a releasable ratchet coupled effectively to the housing and the spring enclosure for adjustment of spring tension. The housing may also include a second opening for the introduction of powdered chalk and a separate compartment enclosing the reel and having openings aligned with the housing openings.

6 Claims, 7 Drawing Figures

CHALK LINE REEL STRUCTURE

This invention relates to chalk line reels and more specifically to a novel and improved chalk line reel having a controllable automatic return.

Known chalk line reels are arranged for manual operation in that they are provided with a hand-operated crank to retrieve the line after it has been extended. Since chalk lines are more generally used in building construction, they are subjected to relatively rough treatment with the result that the cranks frequently become bent or otherwise inoperable and delays are often entailed in retrieving the line after it has been extended.

This invention overcomes the difficulties heretofore encountered in the operation and maintenance of chalk lines and provides a novel and improved structure embodying a spring return for the line wherein the rate of return can be controlled by the operator and the chalk line proper is enclosed in a separate compartment which includes means for conveniently introducing powdered chalk into the reel compartment which effectively retains it within the compartment.

Another object of the invention resides in the provision of a novel and improved chalk line reel structure embodying a controlled automatic spring return wherein the spring tension can readily be adjusted.

Still another object of the invention resides in the provision of a novel and improved chalk line reel structure characterized by its durability, simplicity, ease of operation and relatively low cost.

The chalk line reel structure comprises an outer housing, a central rotatable cylindrical member carried by a fixed inner shaft, a chalk line reel carried by the cylindrical member and disposed within the housing, a compartment within the housing and enclosing the reel, and a spiral spring and enclosure therefor with one end of the spring fixed to said cylindrical member and the other end fixed to the enclosure and releasable ratchet-like means for locking said enclosure to said fixed shaft and for adjusting the spring tension, said housing and compartment having a first pair of aligned openings for withdrawing the chalk line carried by the reel and a second pair of aligned openings for feeding powdered chalk to the reel compartment.

The above and other objects and advantages of the invention will become more apparent from the following description and accompanying drawings forming part of this application.

IN THE DRAWINGS

Figures 1, 2, 3, 4, 5, 6:
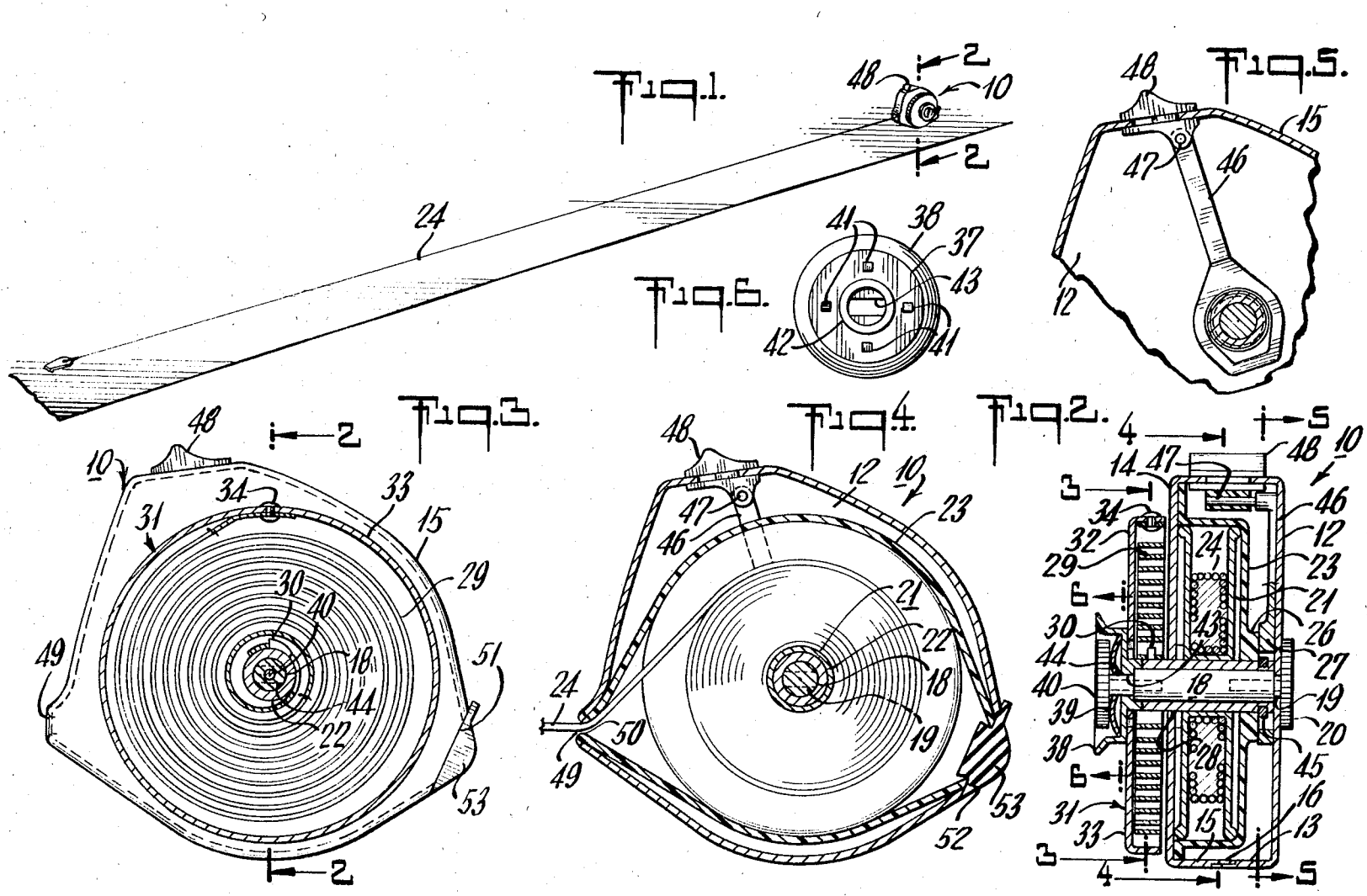
FIG. 1 is a perspective view of the chalk line reel structure in accordance with the invention.
FIG. 2 is a cross sectional view of FIG. 1 taken along the line 2—2 thereof.
FIG. 3 is a cross sectional view of FIG. 2 taken along the line 3—3 thereof.
FIG. 4 is a cross sectional view of FIG. 2 taken along the line 4—4 thereof.
FIG. 5 is a fragmentary cross sectional view of FIG. 2 taken along the line 5—5 thereof.
FIG. 6 is a cross sectional view of FIG. 2 taken along the line 6—6 thereof.

The reel structure in accordance with the invention is generally denoted by the numeral 10 and includes an outer housing 11 formed of two mating portions with one portion comprising an essentially flat plate 12 having an inwardly extending peripheral wall 13. The cooperating housing portion also includes an essentially flat wall or plate 14 having a peripheral wall 15 extending toward the peripheral wall 13. The edges of the peripheral walls 13 and 15 are recessed to provide a lap joint generally denoted by the numeral 16.

Figure 7:
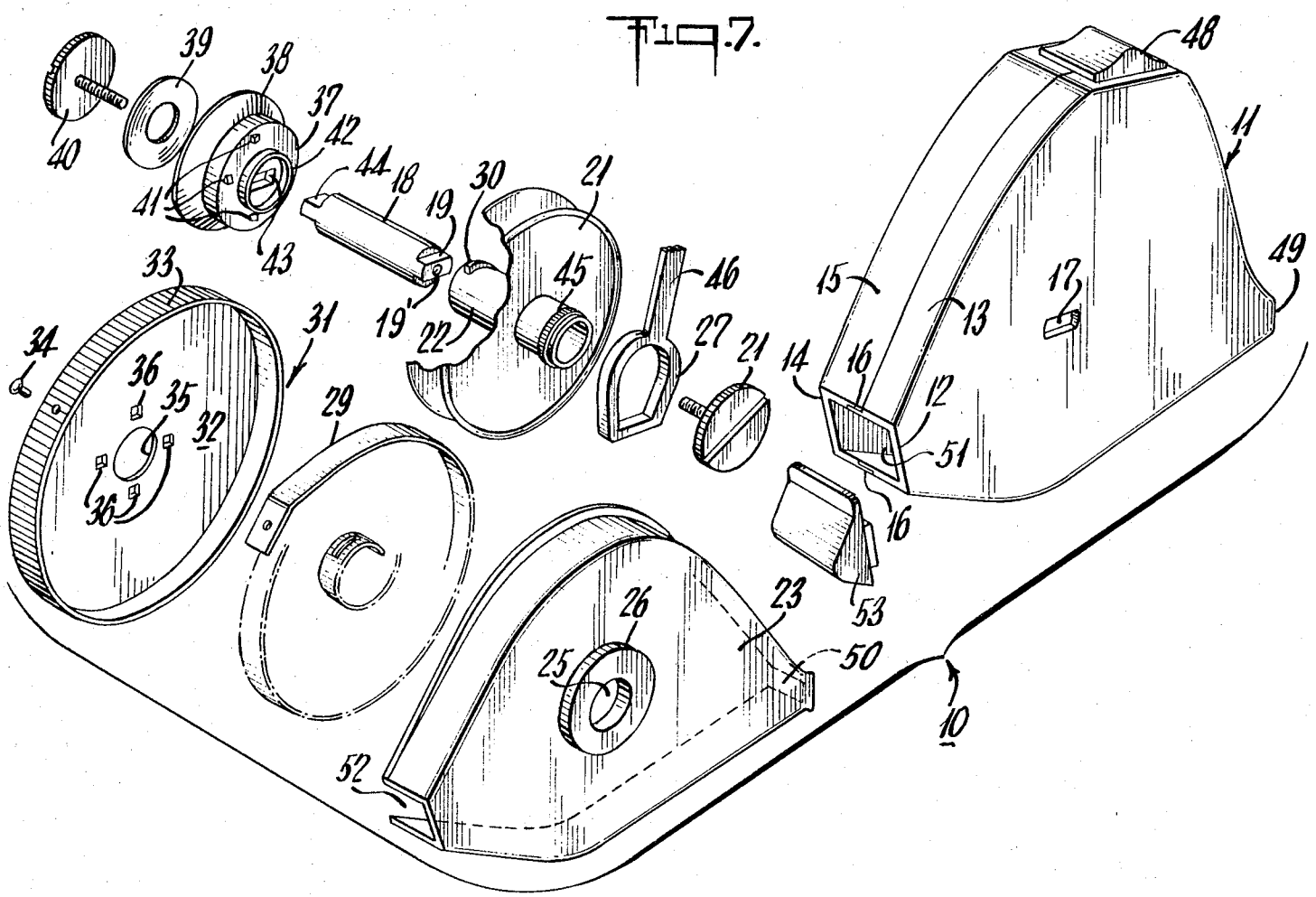
FIG. 7 is an exploded perspective view of the structure shown in FIG. 2.

The wall 12 of the housing 11 has a slotted opening 17 to receive the right hand end of a shaft 18 as shown in FIGS. 2 and 7. For this purpose, the end portion 19 of the shaft 18 is milled to provide an elongated key-like structure 19 which engages the slot 17. A threaded opening 19' is provided on the right hand end 19 of the shaft 18 to receive a thumb screw generally denoted by the numeral 20 to lock the shaft 18 in engagement with the housing portion 12.

A reel carrying the chalk line is denoted by the numeral 21 and is disposed in the housing 11 and adjoining the wall or plate 14 of the housing 11. The reel 21 is carried by a sleeve 22 and the reel is secured to the sleeve by welding or other suitable means. The sleeve 22 is rotatably carried by the shaft 18 and therefore can rotate relative to the shaft, the latter being fixed to the wall or plate 14 as previously described. The reel 21 is provided with a separate enclosure 23 defining a reel compartment and this compartment, as will be pointed out, will retain the powdered chalk fed into the compartment for the purpose of coating the chalk line, the latter generally being denoted by the numeral 24. The compartmental structure 23 includes a central opening 25 surrounded by a collar 26. The opening 25 accommodates the sleeve 22 and the collar 26 slidably engages a clutching member 27 to be described, the latter also surrounding the sleeve 22.

The side wall or plate of the housing portion 14 has a central opening 28 to accommodate the left-hand end portion of the sleeve 22, as shown for instance in FIG. 2. A spiral spring overlies the outer side of the wall 14 of the housing and the inner end of the spiral spring 29 is fixed to the extending portion of the sleeve 22 by a pin 30. A spring enclosure 31 having an outer plate 32 and an inwardly extending peripheral flange 33 encloses the spring and the outer end of the spring 29 is fixed to the flange 33 by means of a rivot or other suitable means 34. The wall portion 32 of the spring enclosure 31 has a central opening 35 surrounded by one or more openings 36 which in the present embodiment of the invention includes four such openings. The central opening 35, as will be described, accommodates a ratchet or locking means for holding the enclosure 32 in a fixed position after appropriate tension has been applied to the spring by rotation of the enclosure 32.

The enclosure 32 is held in adjusted position by means of the cup-shaped member 37 having a flared edge portion 38, a spring 39 and a thumb-screw 40. The cup-shaped portion in the instant embodiment of the invention has four projections 41 disposed on a radius corresponding to the radius of the openings 36 in the enclosure 31 as previously described. The angular spacing of the projections 41 also coincides with the angular spacing of the openings 36 so that the projections 41 can be aligned with openings 36. The cup-shaped member 37 further includes an annular collar 42 extending therefrom and an elongated or slotted opening 43 which engages the elongated key-like portion 44 of the shaft 18. The length of the end portion 44 of the shaft 18 is made long enough so that when the thumb screw 40 is loosened, the cup-shaped member 37 can be moved outwardly a distance sufficient to disengage the projections 41 from the openings 36. In this position, the enclosure 31 can be rotated as desired. When the appropriate spring tension is attained, the thumb screw is tightened with the projections 41 in engagement with the openings 36 to thereby lock the enclosure 41 against rotation. The spring 39 immediately beneath the thumb screw 40 will maintain sufficient pressure on the cup-shaped member 37 to hold it in firm engagement with the enclosure 31. In this way, the spring tension can be readily adjusted to insure complete retraction of the chalk line after it has been extended.

The clutching means for controlling the return of the chalk line and for holding it in an extended position is illustrated more clearly in FIGS. 2, 5 and 7. The right hand end of the sleeve 22, as shown in FIGS. 2 and 7, is provided with a band of rubber-like material 45 held in position by an appropriate groove formed in the sleeve 22. The clutching member 27, which has a horse-show configuration with a closed bottom portion, surrounds the band 45 and has a lever arm 46 extending outwardly therefrom. The outer end of this arm is pivoted by means of a shaft 47 to a control knob 48 slidably carried by the housing 11. With this arrangement, when the knob is moved to the right, as shown in FIG. 5, the clutch member 27 is moved downwardly and will permit the sleeve 22 to rotate freely. As the knob 48 is moved to the left, it will raise the member 27 which will then function to break the rotation of the sleeve 22. When the knob 48 is moved all the way to the left, the sleeve 22 will be locked in position. Should the chalk line be in the extended position, it can then be retracted at the desired rate by moving the knob to the right a distance that will provide the desired rate of return for the operator.

Referring now to FIGS. 4 and 7, the housing 11 includes a chalk line opening 49 and the compartment 23 includes a corresponding opening 50 in alignment with the opening 49. A second opening 51 is provided in the housing 11 and a corresponding opening 52 is provided in the compartment 23 in alignment with the opening 51. A removable closure 53 is provided for closing the openings 51 and 52 and constitutes means for introducing powdered chalk into the reel compartment. If desired, the closure 53 may take any desired form or configuration including a diaphragm-like member having one or more slits to facilitate the introduction of the powdered chalk without removal of the closure.

With the structure heretofore described, numerous advantages are attained including a saving in time since the chalk line can be rapidly retracted without the need for external cranks which frequently catch on to the hands or clothing of the operator and which often break or drop off when winding or unwinding. In addition, powdered chalk can be readily and easily introduced into the reel compartment and should it be necessary to replace the chalk line, the structure can be quickly and easily disassembled to remove the old line and replace it with the new line. Furthermore, the structure is compact, easy to operate and readily fits into the palm of the hand. If desired, a clip can be fastened to the outer surface of the housing portion 2 which will not interfere in any way with the operation of the device. In view of the compact arrangement of the structure, it can fit readily into the user's pocket or pouch.

While only one embodiment of the invention has been illustrated and described, it is apparent that alterations, changes and modifications may be made without departing from the true scope and spirit thereof.

What is claimed is:

1. A chalk line reel structure comprising a reel having a chalk line wound thereon, a closed housing surrounding said reel and having an opening through which said line extends, a central shaft rotatably carrying said reel, spring means on one side of said housing and fixed at one end relative to said reel, an enclosure enclosing said spring means with the other end of said spring means secured to said enclosure, adjustable ratchet means coupling said housing and enclosure to impart the desired tension to said spring when said chalk line is in the retracted position, clutch means carried by said housing and operable to lock said reel with the line in a selected extended position and to control the rate of return of said line under the action of said spring means, said housing being formed of two spaced plates with a peripheral wall closing the space defined by said plates, means fixedly keying said shaft to one of said plates, said reel including a sleeve fixed thereto for rotatably engaging said shaft, said other plate having a central opening through which said sleeve extends, said one end of said spring being fixed to said sleeve and said ratchet means couples said enclosure to said shaft, said clutch means includes a braking member for engaging said sleeve, a lever arm connected to said braking member and a brake actuating member secured to the lever arm and operable to gradually apply said brake to control rotation of said reel upon retraction of said chalk line and to hold said brake in a reel locking position, a reel enclosing compartment within said housing and having a sleeve receiving opening, said compartment having a chalk line opening in alignment with the first said housing opening and said housing and compartment each include second aligned openings for feeding powdered chalk to said chalk line and means for closing said second openings.

2. A chalk line reel structure according to claim 1 wherein said ratchet means comprises a circular element overlying said spring enclosure and keyed to the other end of said shaft and axially displaceable relative thereto, said element having at least one projection extending from the surface thereof facing said enclosure, said enclosure including at least one projection receiving opening and means including a spring and thumb-screw threadably engaging the adjoining end of said shaft to hold said projection in engagement with said projection receiving opening to lock said enclosure relative to said housing, the last said means being releasable to disengage said projection and permit said enclosure to be rotated relative to said housing.

3. A chalk line reel structure comprising a housing formed of a pair of spaced plates of similar configuration and a peripheral wall closing the space defined by said plates, a centrally positioned shaft extending between said plates, keyed to one of said plates and secured against axial displacement, a sleeve rotatably carried by said shaft and extending through an opening in the other of said plates, a reel within said housing and carrying a chalk line, said reel being fixedly secured to said sleeve, a spiral spring overlying said other plate and having its inner end fixed to said sleeve, a spring enclosure surrounding said spring with the other end of said spring fixed to said enclosure, ratchet like means overlying said enclosure with one portion keyed to said shaft and releasably engaging a cooperating portion on said enclosure to permit rotation of said enclosure to produce the desired spring tension and to lock said enclosure against rotation at the desired spring tension, said housing including at lease one opening through which said chalk line extends and for introducing powdered chalk to said chalk line reel, and clutch means including a control lever engaging said sleeve to lock the sleeve and reel in a selected position and to control the rate of return of the chalk line after being extended.

4. A chalk line structure according to claim 3 including a compartment within said housing enclosing said reel and having a chalk line opening in alignment with the first said opening.

5. A chalk line reel structure according to claim 4 wherein the housing and compartment are each provided with second aligned openings for introducing powdered chalk to said reel compartment and means for closing said second aligned openings.

6. A chalk line reel structure according to claim 4 wherein said one portion of said ratchet-like means includes a disc-shaped memeber lying against said enclosure and having at least one projection extending from the inner surface thereof, said enclosure having at least one projection receiving opening and means for holding said projection in engagement with the last said opening after the enclosure has been rotated to achieve the desired opening tension.

* * * * *